US005542162A

United States Patent [19]

Biller

[11] Patent Number: 5,542,162

[45] Date of Patent: Aug. 6, 1996

[54] BUCKLE FOR SAFETY BELTS

[75] Inventor: Joachim Biller, Lorch, Germany

[73] Assignee: TRW Repa GmbH, Alfdorf, Germany

[21] Appl. No.: 428,467

[22] Filed: Apr. 25, 1995

[30] Foreign Application Priority Data

May 6, 1994 [DE] Germany ..... 44 16 138.7

[51] Int. Cl.[6] ..... A44B 11/26

[52] U.S. Cl. ..... 24/641

[58] Field of Search ..... 24/633, 636–642, 24/645; 297/468

[56] References Cited

U.S. PATENT DOCUMENTS

| | | | |
|---|---|---|---|
| 3,895,196 | 7/1975 | Lewis | 24/641 X |
| 4,358,877 | 11/1982 | Burke | 24/641 |
| 4,543,693 | 10/1985 | Cunningham | 24/641 X |
| 4,562,625 | 1/1986 | Doty et al. | 24/641 X |
| 4,797,984 | 1/1989 | Seto et al. | 24/641 |
| 4,802,266 | 2/1989 | Doty et al. | 24/641 X |
| 5,054,171 | 10/1991 | Tanaka | 24/641 X |
| 5,066,042 | 11/1991 | Föhl | 24/641 |
| 5,097,571 | 3/1992 | Föhl | 24/641 |
| 5,119,532 | 6/1992 | Tanaka | 24/641 |
| 5,163,207 | 11/1992 | Krautz et al. | 24/641 X |
| 5,341,546 | 8/1994 | Burke | 24/641 |

FOREIGN PATENT DOCUMENTS

| | | | |
|---|---|---|---|
| 2071753 | 9/1981 | United Kingdom | 24/641 |

*Primary Examiner*—Peter M. Cuomo
*Assistant Examiner*—Robert J. Sandy
*Attorney, Agent, or Firm*—Tarolli, Sundheim, Covell, Tummino & Szabo

[57] ABSTRACT

The buckle for safety belts is based on the well accepted pivotal latch design and using simple means is designed to resist the effects of a belt pretensioner. The pivotal latch is secured in a locked position by a catch plate. The catch plate is for its part held by two locking balls, held between a recess in the catch locking plate and an arresting plate extending parallel to the catch plate. For release of the buckle firstly this locking plate must be moved using a mass-balanced system.

6 Claims, 3 Drawing Sheets

BUCKLE FOR SAFETY BELTS

The invention relates to a buckle for safety belts. In a buckle shown in U.S. Pat. No. 5,097,571, a pivotal latch is supported in a load bearing frame. In a locking position the latch engages the detent edge of an insertion tongue. A catch member is slidingly mounted on the frame for movement athwart the pivot direction of the pivotal latch between a release position, in which it releases the pivotal latch and a locking position, in which it locks the pivotal latch in an engaged position thereof. A release button also supported on the frame, when operated, causes sliding of the catch member into the released position.

The catch member in the form of a plate is in the case of this design of the buckle urged by a compression spring against the pivotal latch and is directly slid by the release button. The forces occurring at the release button and the locking plate due to inertia at the end of a belt pretensioning stroke, meaning that the buckle is shifted toward the floor of the vehicle, are directed in the release direction of the button so that special features must be adopted to prevent release of the buckle of its own accord. For this purpose a locking catch is mounted on the release button, which owing to its inertia during abrupt acceleration of the release button is pivoted and slips into a detent opening on the frame of the buckle. The pivoting of the pawl must take place very smartly for ensuring the desired locking of the release button. In the case of extremely high acceleration rates of the buckle it is not always possible to ensure that this is so. Moreover, the loads which must be resisted by the pawl assume very high values, which include both the entire mass of the release button and also the mass of the catch plate and of the catch pawl itself.

The invention provides a buckle for safety belts which is prevented from being unintentionally released even at extremely high acceleration values of 4000 g or more and does not entail any modifications in principle in well accepted designs of the pivotal latch type.

In accordance with the invention the catch member, which holds the pivotal latch in its closed position, is for its part locked by at least one locking body in the locking position, such locking body being able to be moved athwart the direction of sliding of the catch member between a locked position and a released position. Owing to its mobility being limited to the movement across the sliding direction the catch member does not respond to acceleration in a direction coinciding with the actuation direction of the release button. Accordingly the locking body will remain in its locking position even in the case of extremely strong acceleration in this direction. The buckle is consequently securely locked independently of the timing of events.

In the preferred embodiment of the buckle the locking body is for its part able to be arrested in its locking position by an arresting member which is able to be slid parallel to the direction of shifting of the catch member. Accordingly on the one hand the catch member is held by the locking body to prevent response to acceleration in the actuation direction of the release button and on the other hand the locking body is for its part is prevented from responding to acceleration perpendicular to this direction by the arresting member. Accordingly the buckle is generally secured against the effect of acceleration in every direction.

For release of the buckle in this form it is firstly necessary to shift the locking member in order to release the locking body, which then for its part renders possible sliding of the catch member in order to release the pivotal body. The necessary movement may be readily produced by means of a two-armed direction changing lever which is pivotally mounted on the catch member and whose first end engages the release button while its second end is connected with the locking member. The direction changing lever, the locking member and the parts, engaging the same, of the release button are compensated inertia-wise with respect to acceleration in the direction of actuation of the release button so that even in the case of extremely high values of such acceleration they remain relatively unaffected.

Further advantageous developments and convenient forms of the invention will be understood from the following detailed descriptive disclosure in conjunction with the accompanying drawings.

Figure 1:
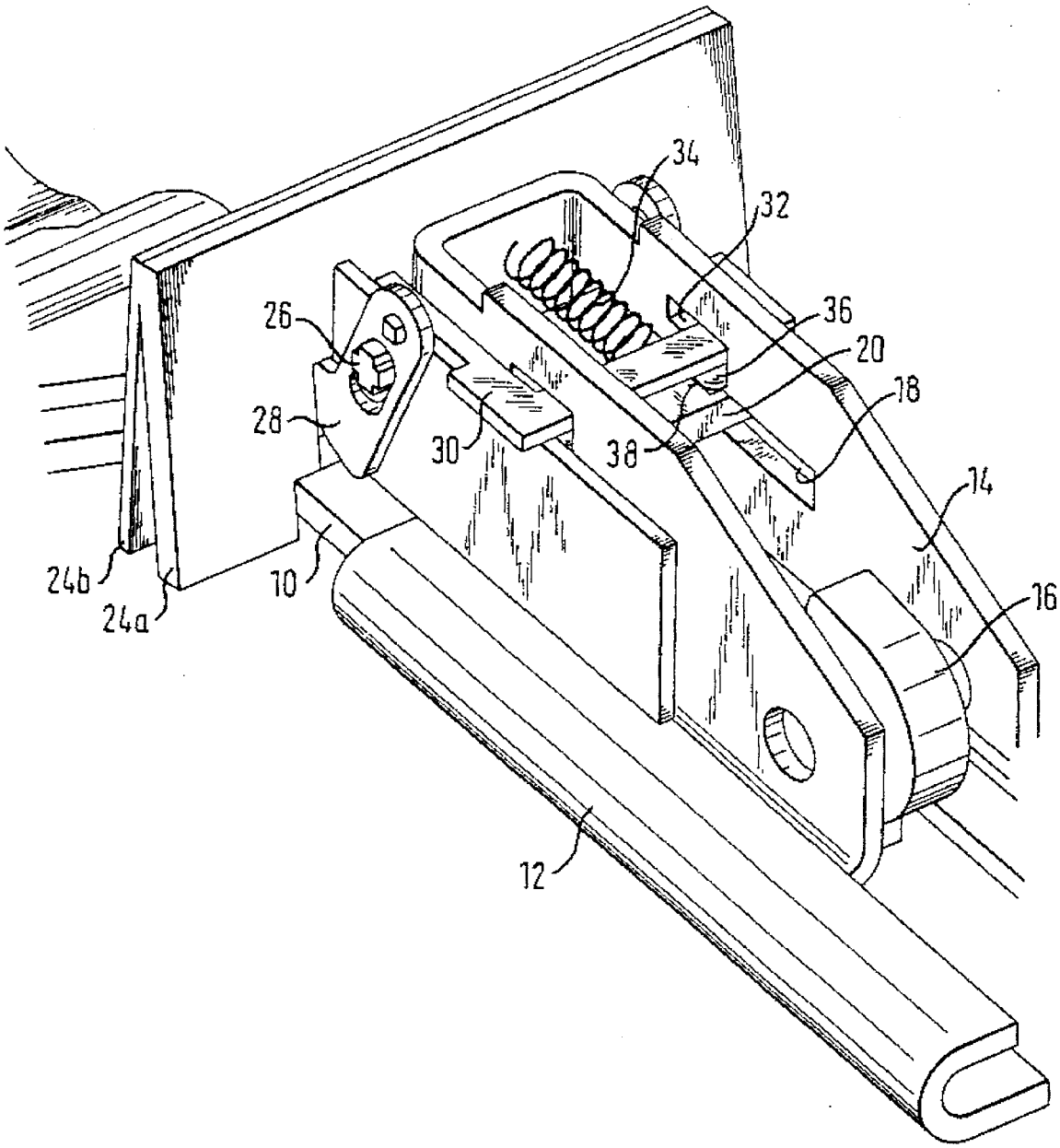
FIG. 1 is a diagrammatic perspective view of the main functional parts of the buckle.

The buckle for safety belts connects a conventional insertion tongue 10 with a fitting 12, on which a belt pretensioner, a so-called buckle pretensioner, may act. The buckle comprises a load carrying frame 14 connected with the fitting 12 and which, when considered in plan view is, is bent in a U shape. Between the limbs thereof a pivotal latch 16 is mounted for pivoting motion. In the secured setting (FIG. 2) the pivotal latch 16 has its hook 16a in engagement with a detent edge 10*a* on the tongue 10. A catch plate 20 runs in two guide slots 18, parallel to the tongue 10, in the limbs of the frame 14. A compression spring 22 is borne between the catch plate 20 and a support surface 16*b* on the pivotal latch 16 and urges the pivotal latch 16 in an opening direction, while however at the same time urging the catch plate 20 into a locked position, in which it constitutes an abutment for an upwardly extending ear 16*c* on the side, which is remote from the hook 16*a*, of the pivotal latch 16. The catch plate 20 hence retains the pivotal latch 16 in its secured position as shown in FIG. 2.

On the frame 14 a two-part release button 24*a* and 24*b* is furthermore pivotally mounted. The two parts 24*a* and 24*b* of the release button are able to pivot about a common axis and are urged by spring force acting at their free ends. In this case the part 24*a* of the release button engages the adjacent edge of the catch plate 20.

On either side thereof the catch plate 20 has a projecting trunnion 26, on which in each case a two-armed direction changing lever 28 is pivoted using a slot 28*a*. On the upper arm of the deflecting or direction changing lever 28 a locking plate 30 is pivotally connected. The locking plate 30 runs in two parallel guide slots 32 in the two limbs of the frame 14 parallel to the catch plate 20. By means of a compression spring 34 the locking plate 30 is urged in the direction opposite to the direction in which the catch plate 20 is urged by the compression spring 18.

Figure 2:
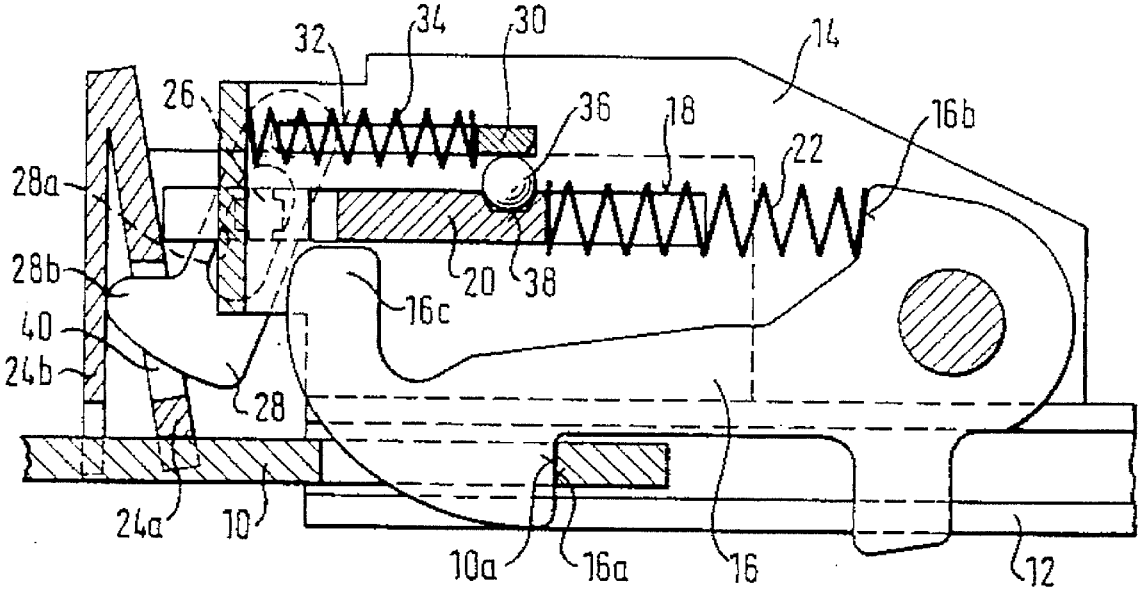
FIG. 2 is a diagrammatic side elevation of the buckle in a condition with the male lug locked and without actuation of the release button.

In the case of the secured position as shown in FIG. 2 the end, which is remote from the lever 28, of the locking plate 30 over two locking balls 36, which are respectively mounted in one of two recesses 38 in the catch plate 20. The locking plate 30 prevents escape of the locking balls 36 from the recesses 38 so that the catch plate 20 is locked in its position.

On its arm remote from the locking plate 30 the direction changing lever 28 possesses a ear 28*b*, which extends through an opening 40 in the part 24*a* of the release button and engages the part 24*b* thereof. The distribution of mass and the participating levers on the part 24*b* of the release button, the pivotal latch 28 and the locking plate 30 is so selected that these parts are mass-balanced in relation to acceleration in the direction of actuation of the release button. Even in the case of extremely high acceleration in this direction such parts therefore remain immobile in relation to the frame 14 of the buckle. Accordingly the locking balls 36 are prevented from coming out of the recesses 38 so that the catch plate 20 is retained in its locking position and the pivot latch 16 remains in its closed position. In the case of acceleration across the direction of the actuation of the release button the locking balls 36 may not more out of the way either, since they are trapped between the catch plate 20 and the locking plate 30. The buckle is therefore immune to the effects of acceleration of any degree and in any direction.

Figure 3:
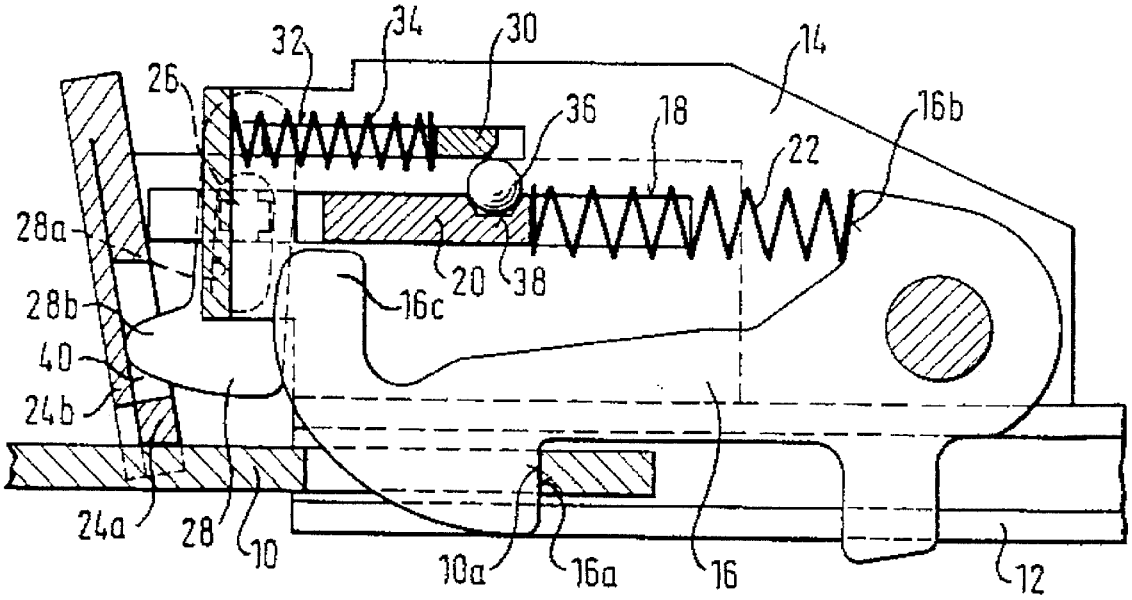
FIG. 3 shows the same buckle at the start of actuation of the release button.

In order to release the buckle as with a conventional pivotal latch buckle the release button is moved in a direction, which corresponds to the direction of insertion of the male lug 10. The part 24*b* of the release button first pushes along the ear 28*b* of the direction changing lever 28 and pivots it so that the locking plate 30 is displaced in the guide slots 32 opposite to the force of the compression spring 34 until the locking balls 36 come free. In this state, as shown in FIG. 3, the parts 24 and 24*b* of the release button are in engagement with one another so that now after the initial first actuating stroke, along a second actuating stroke the catch plate 20 is shifted against the force of the compression spring 22.

Figure 4:
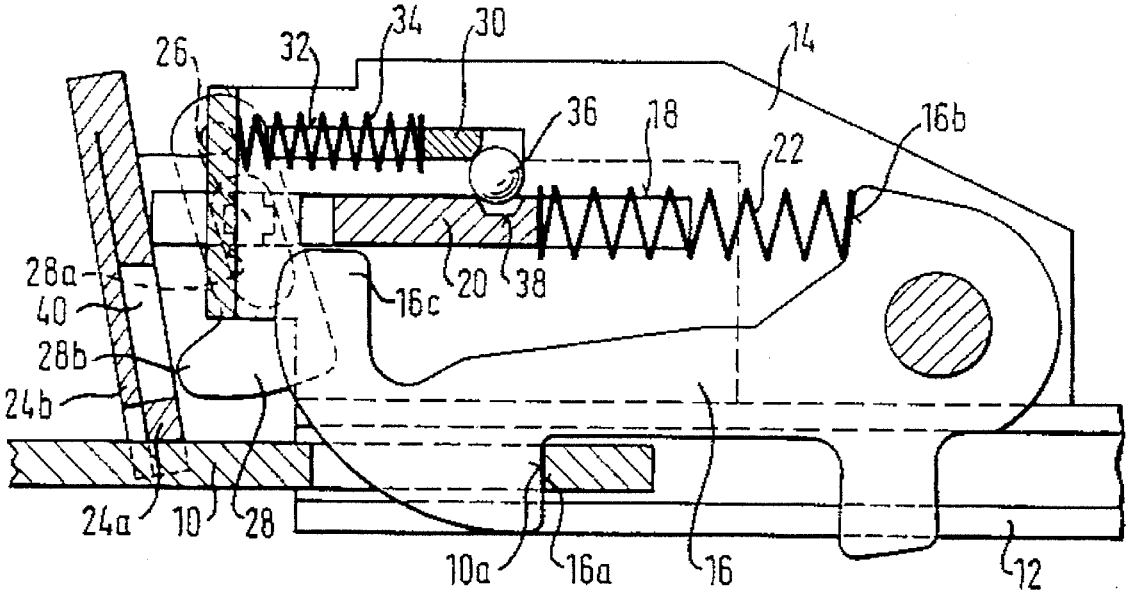
FIG. 4 shows the buckle in the terminal phase of the actuation of the release button.
Figure 5:
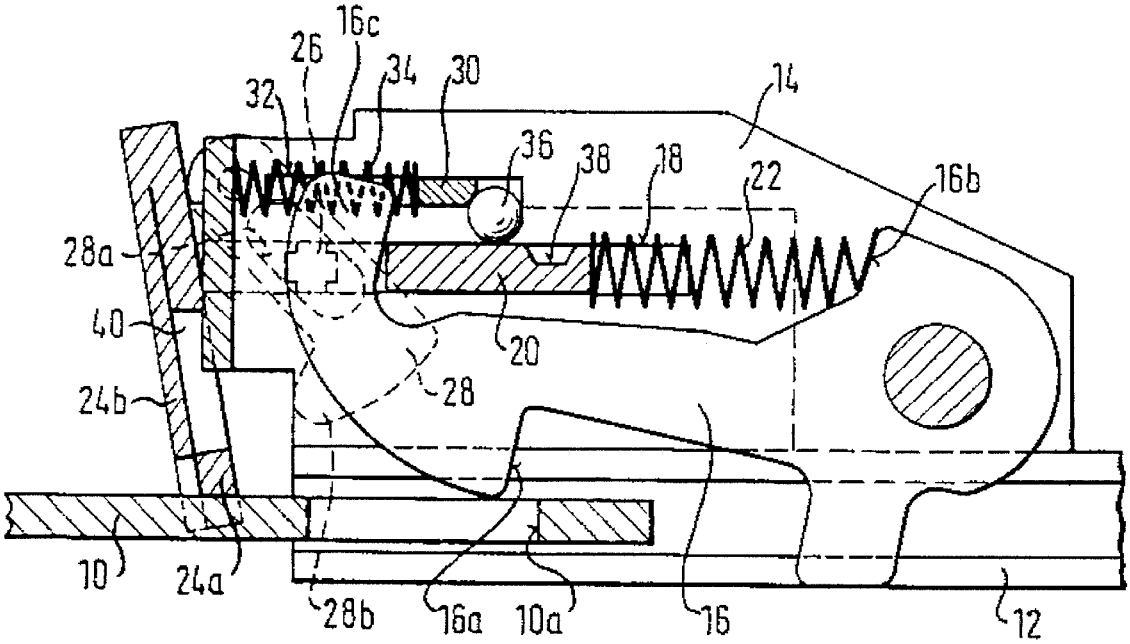
FIG. 5 shows the buckle in the released state with the release button fully depressed.

As shown in FIG. 4 the locking balls 36 are now urged out of the recesses 38 so that the catch plate 20 is able to be moved unhindered until it releases the pivotal latch 16. The same is now pivoted in the clockwise direction by the compression spring 12, the hook 16*a* being released from the detent edge 10*a* of the male lug 10 and it may now be drawn out of the buckle.

What is claimed is:

1. A buckle for a safety belt, comprising a frame, a latch pivotally mounted in said frame and movable between a latching position and a release position, a catch member slidingly mounted in said frame and movable between a blocking position and a retracted position, a release button slidingly guided on said frame and engaging said catch member, and a locking body selectively engaging said catch member to hold the catch member in the blocking position, said latch member being blocked in the latching position by said catch member when said catch member is in the blocking position, said release button, when depressed, disengaging said locking body from said catch member and thereafter moving said catch member to the retracted position thereby enabling the latch member to move to the release position.

2. The buckle of claim 1, wherein an arresting member is slidably guided on said frame in a plane parallel to and spaced from a plane in which said catch member is slidable, said arresting member being movable by said release button from an arresting position in which it holds said locking body in engagement with said catch member, to a disengaged position enabling the catch member to move to the retracted position.

3. The buckle of claim 2, wherein a two-armed lever is pivotally mounted on a support structure connected to said catch member, said arresting member and said release button being coupled to first and second arms, respectively, of said lever.

4. The buckle of claim 3, wherein said release button, when depressed, first pivots the lever until the locking body is disengaged from the catch member, and thereafter moves the catch member to the retracted position.

5. The buckle of claim 3, wherein said lever has an elongate slot engaged about a trunnion integrally formed with said catch member.

6. The buckle of claim 1, wherein said locking body is a roller fitting into a recess in the catch member.

* * * * *